US010086304B1

(12) United States Patent
LaChance, III

(10) Patent No.: US 10,086,304 B1
(45) Date of Patent: Oct. 2, 2018

(54) MODULAR PANEL SYSTEM FOR INTERACTIVE PLAY OR DISPLAY

(71) Applicant: Louis Adelard LaChance, III, Warwick, RI (US)

(72) Inventor: Louis Adelard LaChance, III, Warwick, RI (US)

( * ) Notice: Subject to any disclaimer, the term of this patent is extended or adjusted under 35 U.S.C. 154(b) by 0 days.

(21) Appl. No.: 15/330,262

(22) Filed: Sep. 1, 2016

Related U.S. Application Data

(60) Provisional application No. 62/209,232, filed on Aug. 24, 2015.

(51) Int. Cl.

| | |
|---|---|
| ***A63H 33/10*** | (2006.01) |
| ***A63H 3/52*** | (2006.01) |
| ***A63H 33/04*** | (2006.01) |
| ***A63H 33/08*** | (2006.01) |

(52) U.S. Cl.
CPC ..... *A63H 3/52* (2013.01); *A63H 33/044* (2013.01); *A63H 33/084* (2013.01)

(58) Field of Classification Search
CPC ..... A63H 3/52; A63H 33/04; A63H 33/044; A63H 33/08; A63H 33/082; A63H 33/084; A63H 33/086; A63H 33/10; A63H 33/105; E04B 1/34321; E04B 2001/3276
USPC ..... 446/85, 108, 111, 112, 113, 124, 127; 52/79.5
See application file for complete search history.

(56) References Cited

U.S. PATENT DOCUMENTS

| | | | | | |
|---|---|---|---|---|---|
| 1,985,992 | A * | 1/1935 | Hayman | A63H 33/105 | 376/459 |
| 2,204,319 | A * | 6/1940 | Parsons | A63H 33/044 | 446/112 |
| 2,225,612 | A * | 12/1940 | Allen | E04F 15/04 | 376/459 |
| 2,392,551 | A * | 1/1946 | Roe | E04B 2/08 | 52/309.17 |
| 2,708,329 | A * | 5/1955 | McKee | A63H 33/065 | 446/108 |
| 2,735,146 | A * | 2/1956 | Purviance | A63H 33/105 | 376/459 |
| 2,937,471 | A * | 5/1960 | Parisi | A63H 33/105 | 446/108 |
| 3,729,881 | A * | 5/1973 | Disko | A63H 33/008 | 446/105 |
| 3,820,299 | A * | 6/1974 | Verholt | A47B 96/1466 | 52/282.2 |
| 5,487,690 | A * | 1/1996 | Stoffle | A63H 33/10 | 16/225 |
| 5,647,181 | A * | 7/1997 | Hunts | A63H 33/10 | 312/111 |

(Continued)

*Primary Examiner* — Alexander Niconovich
(74) *Attorney, Agent, or Firm* — Barlow, Josephs & Holmes, Ltd.

(57) ABSTRACT

The modular panel system includes composite panels with grooves integrated into both vertical sides thereof. The grooves engage the protrusions molded into all four sides of the mating element. By sliding panels onto a mating element, a room can be created. Two walls at right angles form a simple room corner. Three walls can become two adjoining rooms and other configurations. When disassembled, the panels and elements can be transported and stored out of the way, which is especially useful when used for large scale dolls, eighteen inches tall or more.

5 Claims, 6 Drawing Sheets

(56) References Cited

U.S. PATENT DOCUMENTS

| | | | | | |
|---|---|---|---|---|---|
| 5,888,114 | A * | 3/1999 | Slocum | A47B 47/0075 | 446/118 |
| 5,954,562 | A * | 9/1999 | Chen | A63H 33/10 | 446/103 |
| 5,957,744 | A * | 9/1999 | Mott | A63H 33/105 | 446/122 |
| 6,520,831 | B1 * | 2/2003 | Craig | A63H 3/52 | 446/105 |
| 6,558,222 | B1 * | 5/2003 | Maddock | A63H 33/105 | 446/105 |
| 8,113,840 | B2 * | 2/2012 | Kuhn | G09B 25/04 | 434/72 |
| 8,147,162 | B1 * | 4/2012 | Burnett | F16B 5/0052 | 312/263 |
| 8,641,155 | B2 * | 2/2014 | Lee | A47B 47/005 | 312/108 |
| 8,671,640 | B1 * | 3/2014 | Thomas | E04B 2/18 | 446/122 |
| 9,016,668 | B1 * | 4/2015 | Christensen | E04H 17/16 | 256/13.1 |
| 9,033,761 | B2 * | 5/2015 | Azmani | A63H 33/105 | 446/122 |
| 2004/0198141 | A1 * | 10/2004 | Buhrman | A63H 33/008 | 446/85 |
| 2014/0030475 | A1 * | 1/2014 | MacInnes | B32B 7/08 | 428/99 |
| 2016/0288009 | A1 * | 10/2016 | Lambert | A63H 33/105 | |

* cited by examiner

MODULAR PANEL SYSTEM FOR INTERACTIVE PLAY OR DISPLAY

CROSS REFERENCE TO RELATED APPLICATION

This application is related to and claims priority from earlier filed provisional patent application Ser. No. 62/209,232, filed Aug. 24, 2015, the entire contents thereof is incorporated herein by reference.

BACKGROUND OF THE INVENTION

The present invention relates to modular panel systems for interactive play or display.

SUMMARY OF THE INVENTION

Interactive doll play often requires a scaled house or room. These take up floor space in the child's room or play area even when not in use. With the popularity of large scale dolls, some 18", this problem is amplified. A simple doll house consisting of a kitchen, dining room and bedroom for an 18" doll can cover 12 square feet.

My invention consists of wall panels and a mating element that can be easily combined to form a room or rooms for playing and when taken apart be stored out of the way.

This system could also be used as portable background art for product display.

My invention consists of wall panels with an integral groove down the length of both vertical edges. This groove will be of a profile that will easily and securely engage the corresponding profile protruding from the edges of the mating element. For the purpose of this application shown is a T-shaped groove but other shapes, dovetail, keyhole and the like could also be used.

Two walls joined to one mating element at right angles will form a simple room. Adding a third panel would create two rooms with a dividing wall. Additional panels could be added to form as many rooms as wanted.

Panels can be made with a composite core sandwiched between rigid surfaces for lighter weight, stability and application of art work.

Panels can be manufactured with architectural details such as a door or window and pre-printed with various background art.

BRIEF DESCRIPTION OF THE DRAWING FIGURES

DESCRIPTION OF THE INVENTION

Figure 1:
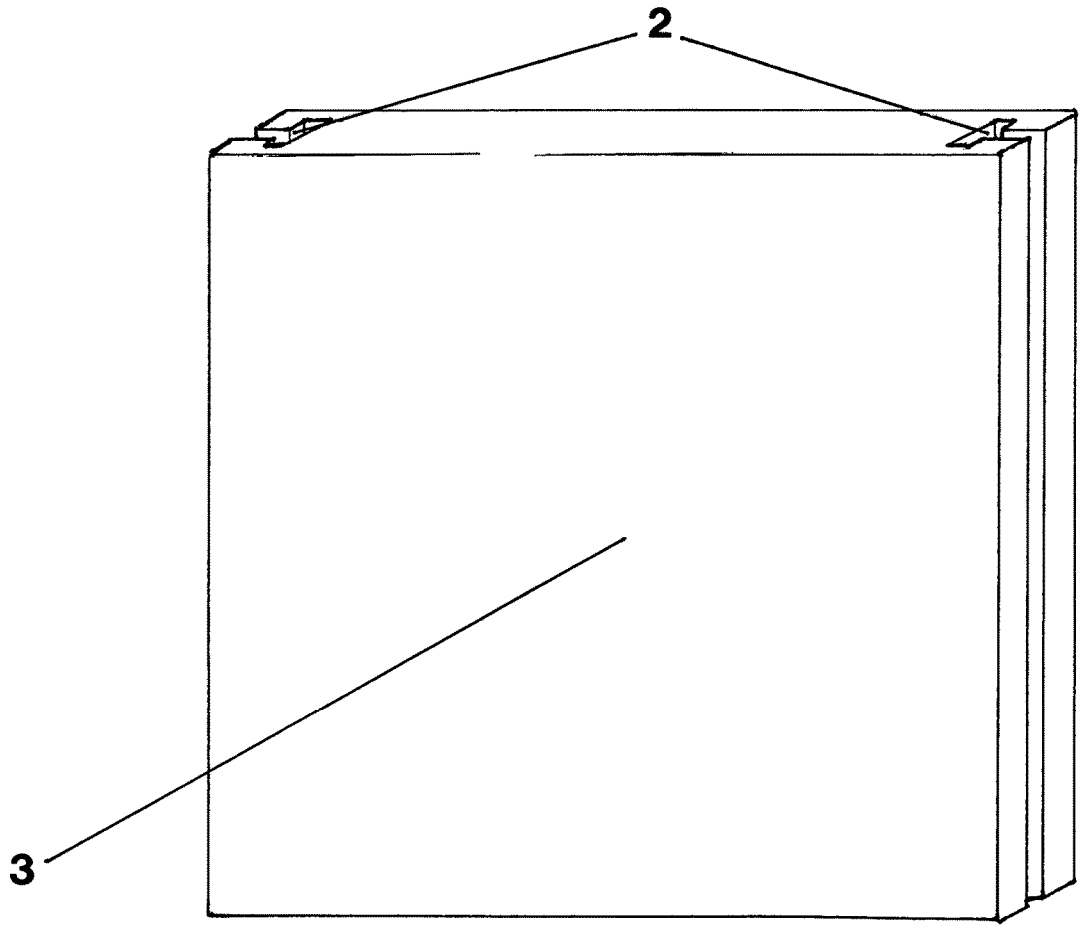
FIG. 1 shows a wall panel (3) with a t-shaped groove down both vertical edges (2)
Figure 2:
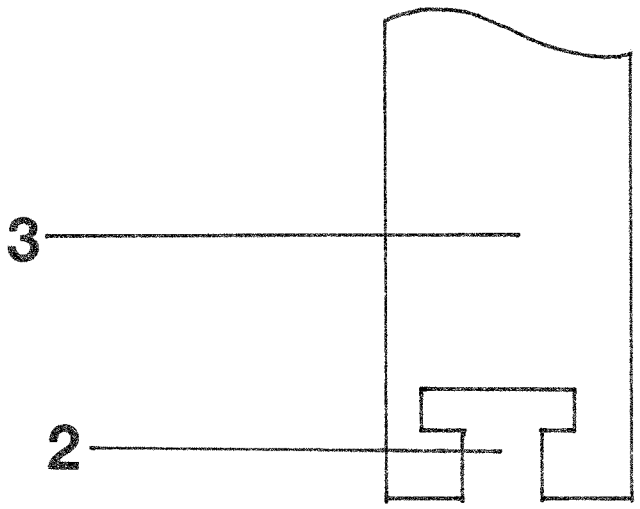
FIG. 2 shows a close-up view of the t-shaped groove (2) in the edge of the panel (3)
Figure 3:
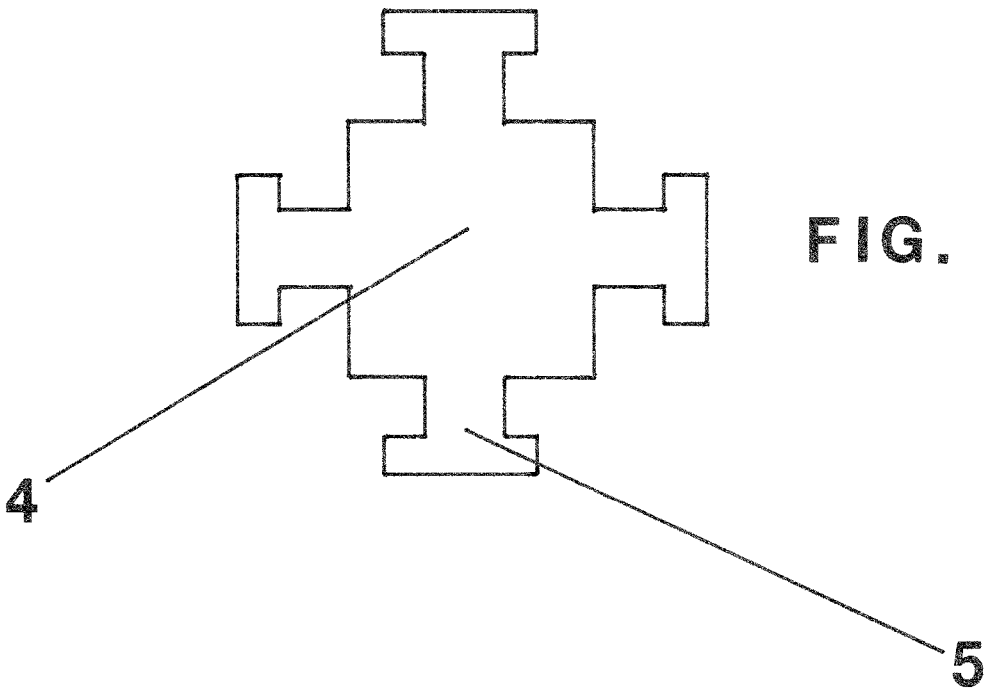
FIG. 3 shows the end view of the mating element (4) with the t-shaped protrusion (5)

As seen in FIGS. 1 and 2, the invention consists of wall panels 3 whose size would vary to accommodate the application and a mating element 4 whose size would equal the height of the panels 3. A mating element in shown in FIG. 3.

Figure 4:
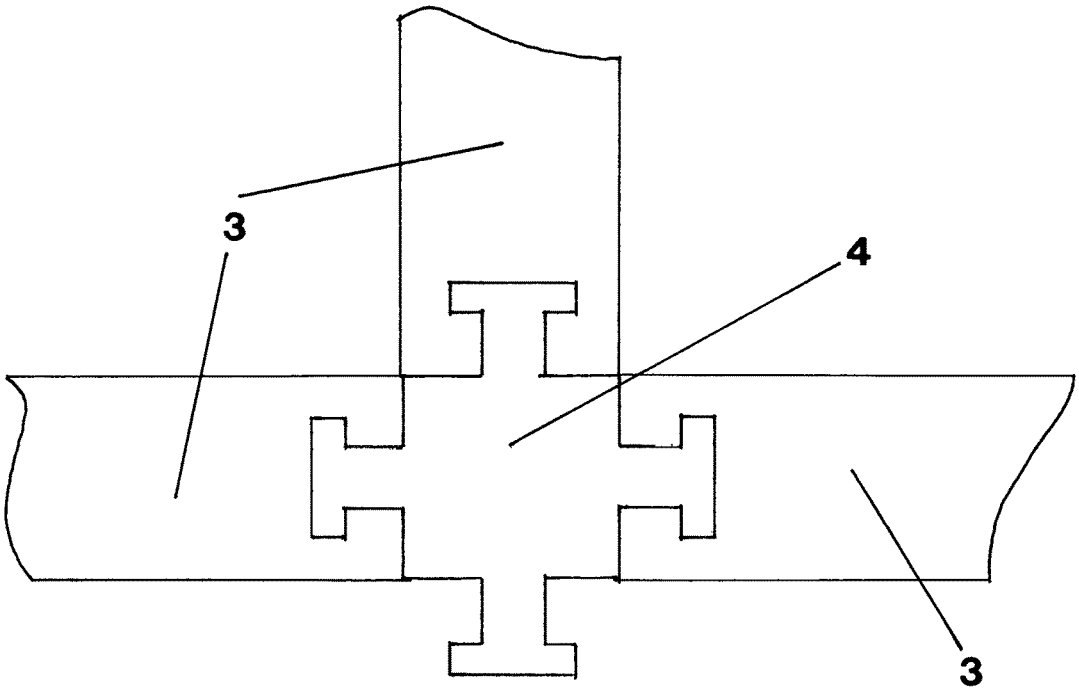
FIG. 4 shows the top view detail of three panels (3) connected to a mating element (4) which could be used to form two adjacent rooms.
Figure 5:
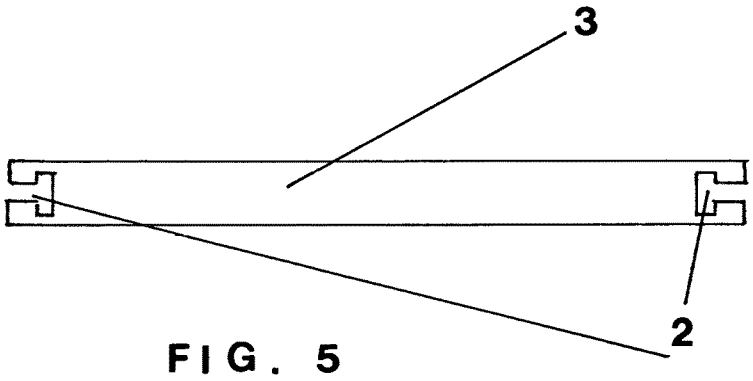
FIG. 5 shows a top view of a single panel (3) with t-shaped grooves (2)
Figure 6:
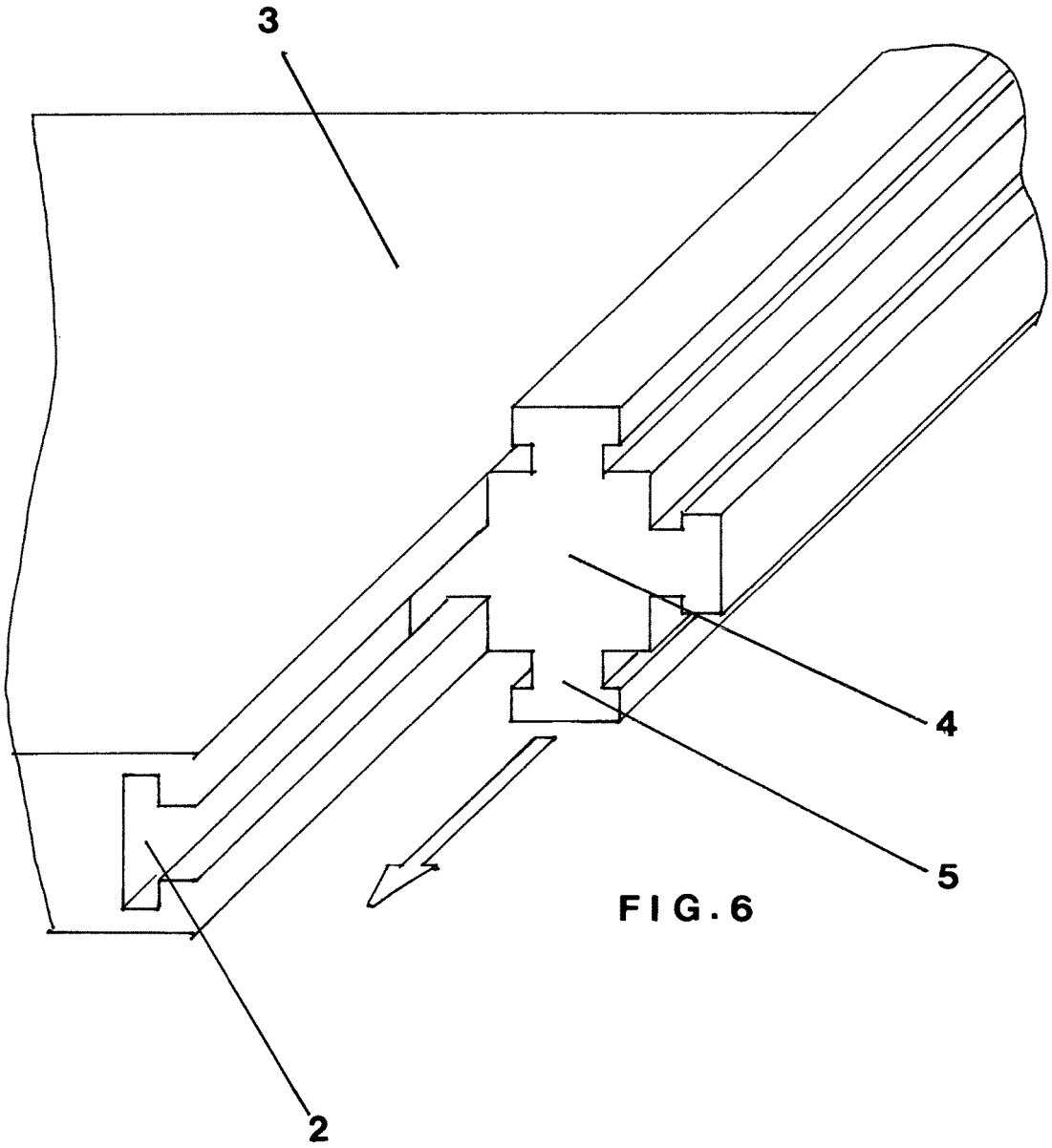
FIG. 6 shows the t-shaped projection (5) of the mating element (4) sliding into the groove (2) of a wall panel (3)
Figure 8:
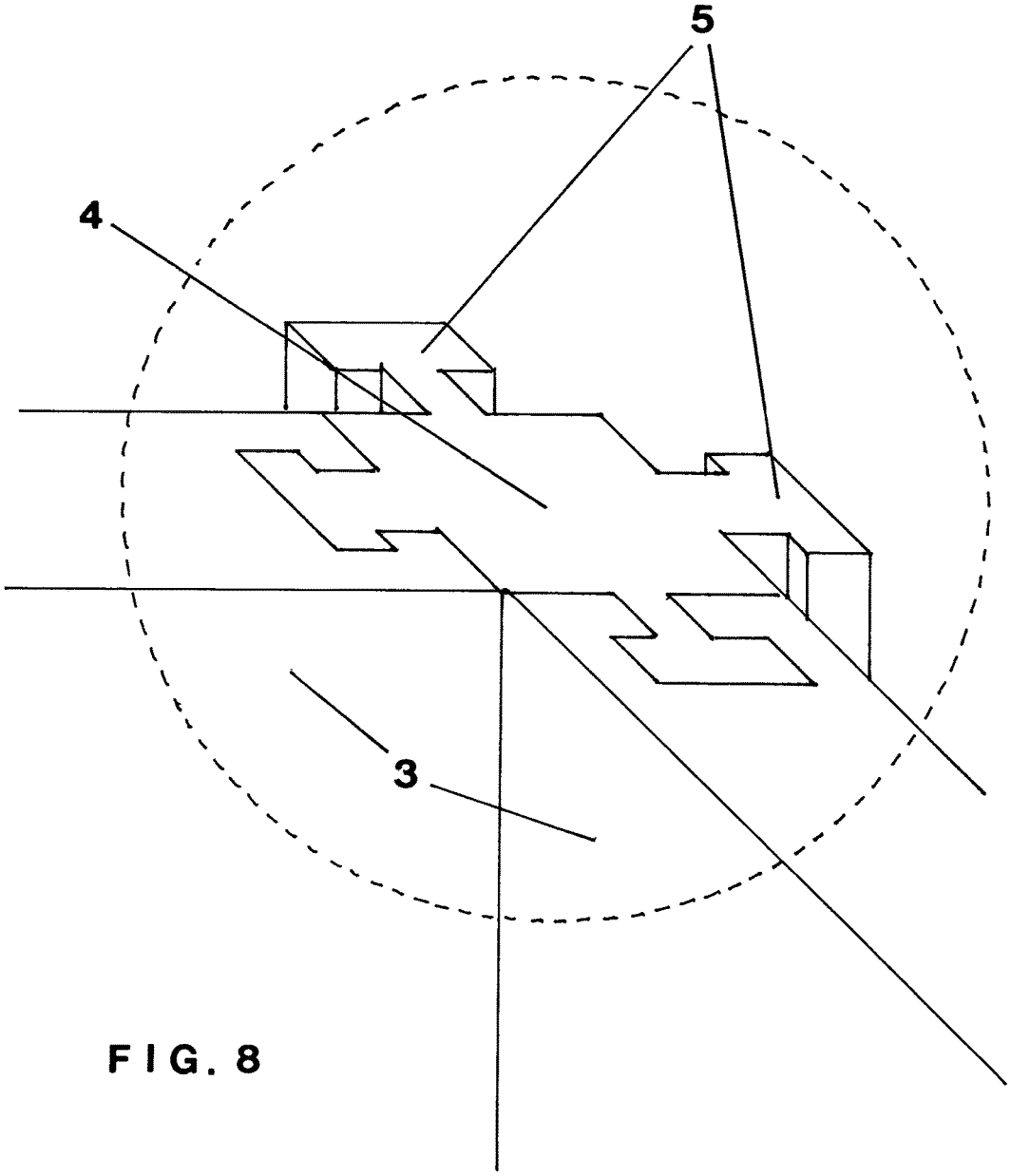
FIG. 8 shows an enlarged view of the joining of the wall panels (3) with the mating element (4) with unused protrusions (5) for additional walls if wanted.

Each mating element 4 can attach to one panel 3 on each of its sides, up to four panels 3 per element 4 as seen in FIGS. 4 and 8. Edge grooves 2 are shown in FIG. 5. The panels 3 attach to the mating element 4 by sliding the edge groove 2 onto the protrusions 5 of the element, as shown in FIG. 6.

Figure 7:
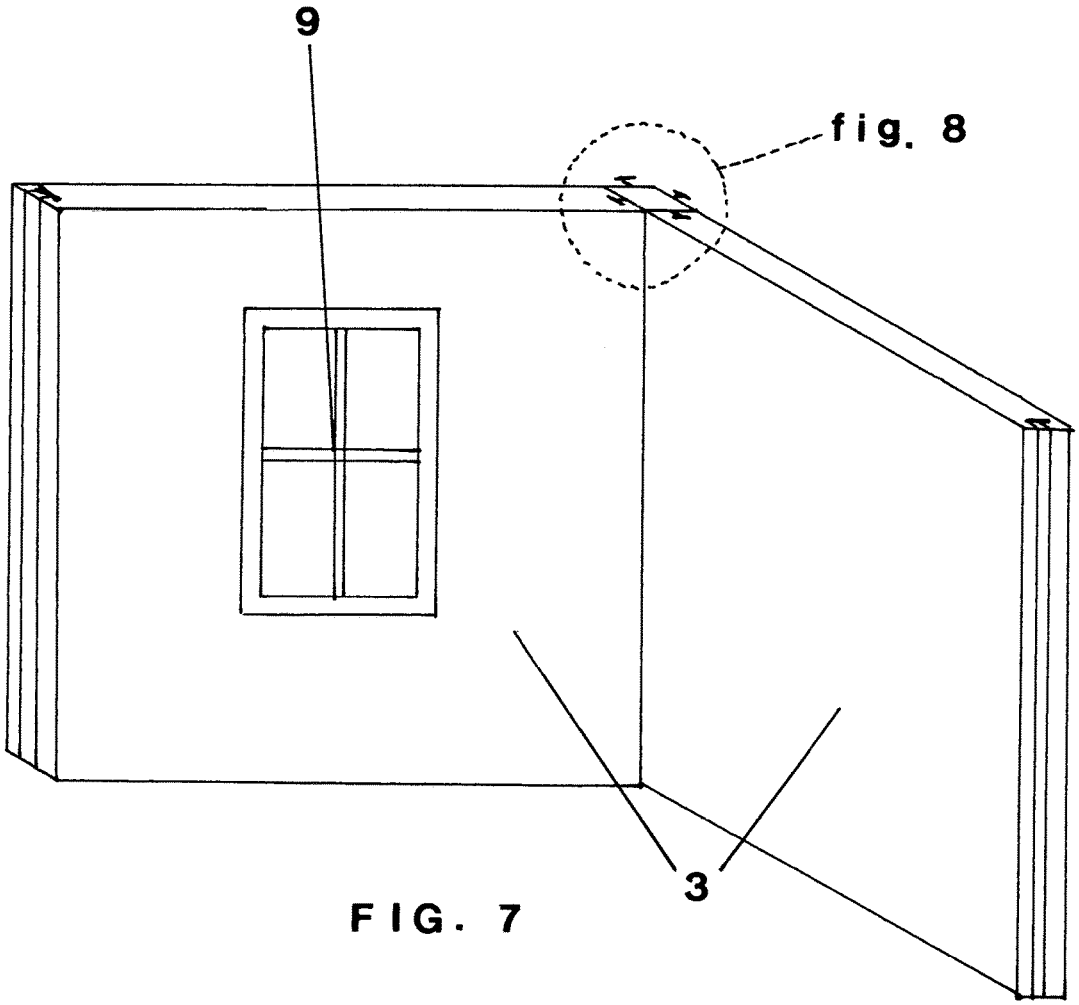
FIG. 7 shows two wall panels (3) connected to a mating element (4) to form a simple room, with detail of joined parts shown in FIG. 8, and window (9) in left wall panel.

The panels 3 would be lightweight, rigid and easily assembled to their mating elements 4, as seen in FIG. 7. The panels 3 may have a window 9 therein. The mating elements 4 could be made of wood, plastic or any rigid material. The panels 3 could have a hard surface for adornment with artwork and accessories. The core could be a lightweight but strong material. The vertical edges 2 will have an integrated groove whose shape will mate with projections on the sides of the mating element 4.

Transporting and assembly can be carried out by young children. When broken down the components will store easily under a bed, in a closet or in an out of the way place. Children could combine their sets to create larger play areas.

Panels 3 would be ideal for portable photography backgrounds, or any situation where portable displays are used.

What is claimed is:

1. A modular panel system of two separate elements, comprising:

a mating element having four sides disposed at ninety degrees from each other with a top side and a bottom side with a substantially square cross-section each having a side width equal to each other;

four engagement members emanating at ninety degrees respectively from each of the four sides of the mating element; the four engagement members each being of a T-shaped configuration;

a first panel having a thickness, having two opposing faces and a first vertical edge; the first vertical edge defining a first panel groove running down and along the first vertical edge in a lateral direction; the first panel being devoid of grooves on its two opposing faces; a first one of the four engagement members of the mating element being freely and laterally slidably receivable in the first panel groove of the first panel in the lateral direction;

a second panel having a thickness, having two opposing faces and a first vertical edge; the first vertical edge defining a second panel groove running down and along the first vertical edge in a lateral direction; the second panel being devoid of grooves on its two opposing faces; a second one of the four engagement members of the mating element being freely and laterally slidably receivable in the second panel groove of the second panel in a lateral direction; the first panel including a second vertical edge, opposite to the first vertical edge, defining a further panel groove on the first panel and the second panel includes a second vertical edge, opposite to the first vertical edge, defining a further panel groove on the second panel; the engagement members of the mating element being capable of engaging with the first panel groove, the further groove in the first panel first panel, the second panel groove or the further groove in the second panel; the first panel groove and the second panel groove are configured and arranged to laterally slidably receive one of the four engagement members and the first panel groove and the second panel groove have a complementary T-shaped configuration to the T-shaped configuration of the engagement members;

the side width of each of the four sides of the mating element, the thickness of the first panel and the thickness of the second panel having substantially the same dimension as each other; and wherein the mating element releasably and non-fixedly joins the first panel to the second panel without the use of adhesives or additional fasteners to form an erected structure with the first engagement element and second engagement element being hidden from view.

2. The modular panel system of claim 1, wherein the first panel and the second panel are lightweight enough to be transported and assembled by young children.

3. The modular panel system of claim 1, wherein the first panel and the second panel are positioned linearly or at an angle relative to each other.

4. The modular panel system of claim 1, wherein the first panel and the second panel and mating elements can be are assembled into room walls or multiple rooms.

5. The modular panel system of claim 1, wherein the first panel and the second panel are scalable for dolls of any size to configure modular play areas for larger sized dolls where permanent rooms or houses are impractical due to their large size.

* * * * *